US008092267B2

(12) United States Patent
Taylor et al.

(10) Patent No.: US 8,092,267 B2
(45) Date of Patent: Jan. 10, 2012

(54) SUBMARINE ESCAPE SUIT ASSEMBLIES

(75) Inventors: Richard Taylor, Ruthin (GB); Steve Littler, Moreton (GB); Robert J Prendergast, Bootle (GB)

(73) Assignee: Survitec Group Limited (GB)

( * ) Notice: Subject to any disclaimer, the term of this patent is extended or adjusted under 35 U.S.C. 154(b) by 230 days.

(21) Appl. No.: 12/442,373

(22) PCT Filed: Sep. 11, 2007

(86) PCT No.: PCT/GB2007/003457

§ 371 (c)(1),
(2), (4) Date: Apr. 27, 2009

(87) PCT Pub. No.: WO2008/035040

PCT Pub. Date: Mar. 27, 2008

(65) Prior Publication Data

US 2009/0301377 A1 Dec. 10, 2009

(30) Foreign Application Priority Data

Sep. 21, 2006 (GB) ..... 0618630.8

(51) Int. Cl.
*B63B 35/58* (2006.01)

(52) U.S. Cl. ..... 441/42; 441/105

(58) Field of Classification Search ..... 441/40, 441/42, 80, 129, 102–105
See application file for complete search history.

(56) References Cited

U.S. PATENT DOCUMENTS 2,814,382 A * 11/1957 Lassiter ..... 53/408
3,198,163 A * 8/1965 Williams ..... 116/206
4,569,082 A * 2/1986 Ainsworth et al. ..... 383/3

FOREIGN PATENT DOCUMENTS

| | | |
|---|---|---|
| EP | 0444400 | 9/1991 |
| GB | 2330517 | 4/1999 |
| WO | 9732776 | 9/1997 |

* cited by examiner

*Primary Examiner* — Stephen Avila
(74) *Attorney, Agent, or Firm* — Workman Nydegger

(57) ABSTRACT

A submarine escape suit assembly comprises a submarine escape suit (10) and a liferaft pack (11). The pack (11) is formed by an outer casing (20) that can be pulled open to access a sealed inner casing (21) containing a liferaft. A cord (27) on the inner pack (11) is pulled to commence inflation of the liferaft (10).

13 Claims, 7 Drawing Sheets

SUBMARINE ESCAPE SUIT ASSEMBLIES

The invention relates to submarine escape suit assemblies including a liferaft carried in a pack on a suit.

A submarine escape suit assembly of this kind is disclosed in EP-A-0444400. In that arrangement, the pack remains attached to the suit while inflation is initiated. The liferaft then bursts from the pack for subsequent inflation and deployment outside the pack. It is a problem that some wearers of such a suit feel uncomfortable with the liferaft inflating in this way.

According to a first aspect of the invention, there is provided a submarine escape suit assembly comprising a submarine escape suit and a liferaft pack, the liferaft pack comprising an outer casing attached to the suit and an inner casing held within the outer casing and containing a deflated liferaft, the outer casing being openable to release the inner casing and to expose an actuation device, actuation of the device passing gas to the liferaft for subsequent inflation and boarding.

According to a second aspect of the invention, there is provided a liferaft pack comprising an outer casing for attachment to a submarine escape suit and an inner casing held within the outer casing and containing a deflated liferaft, the outer casing being openable to release the inner casing and to expose an actuation device, actuation of the device passing gas to the liferaft for subsequent inflation and boarding.

The following is a more detailed description of an embodiment of the invention by way, of example, reference being made to the accompanying drawings in which:—

Figure 1:
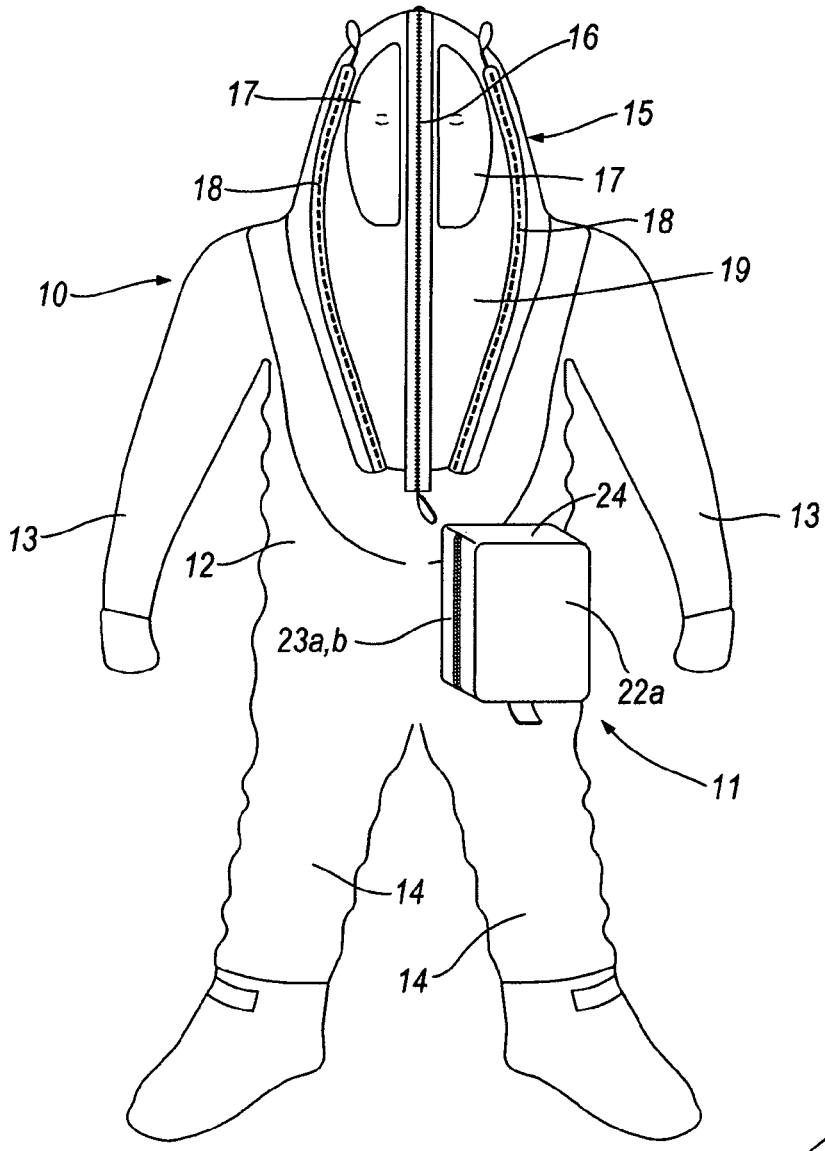
Figure 1:
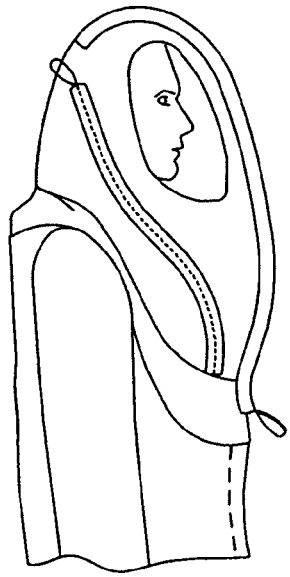
Figure 2:
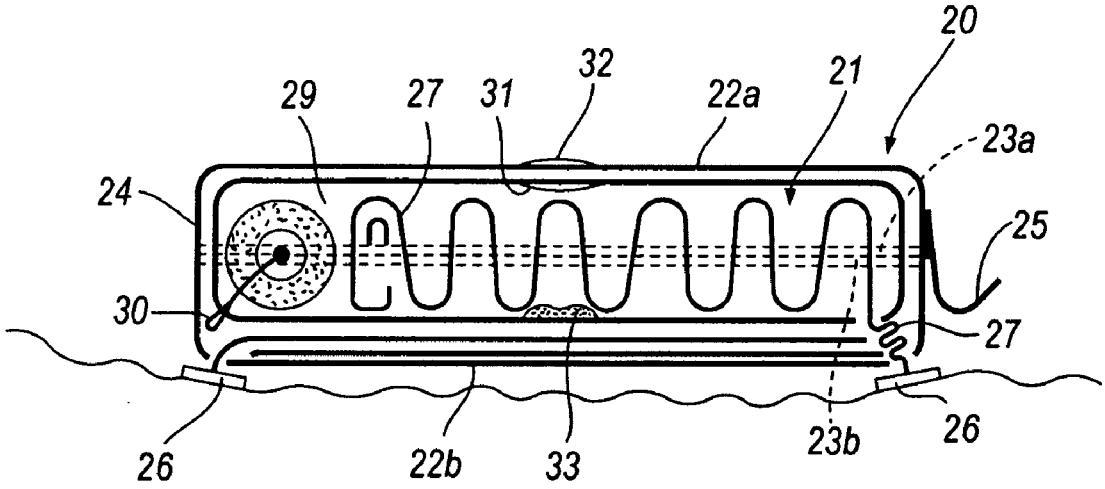
Figure 3:
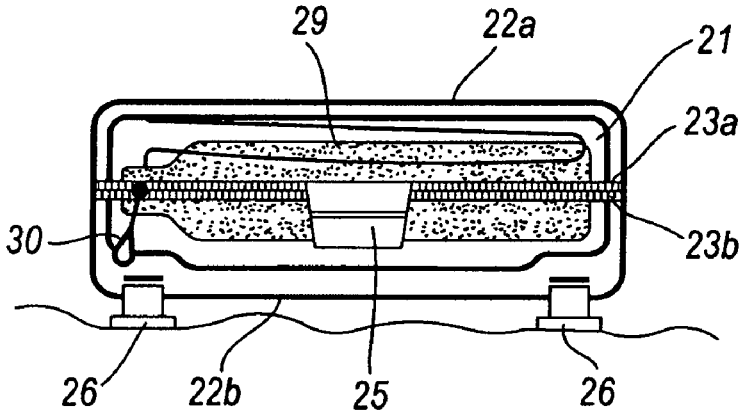
Figure 4:
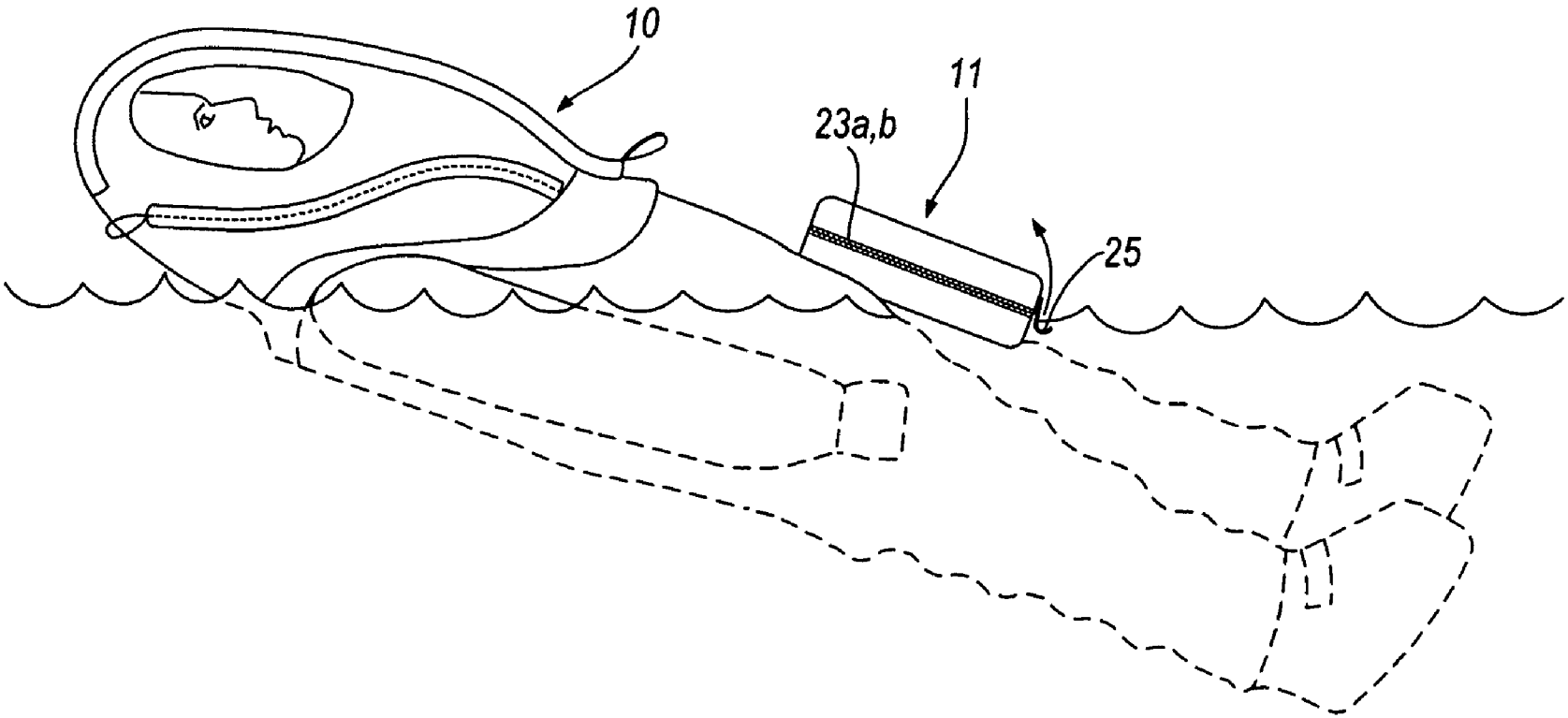
Figure 5:
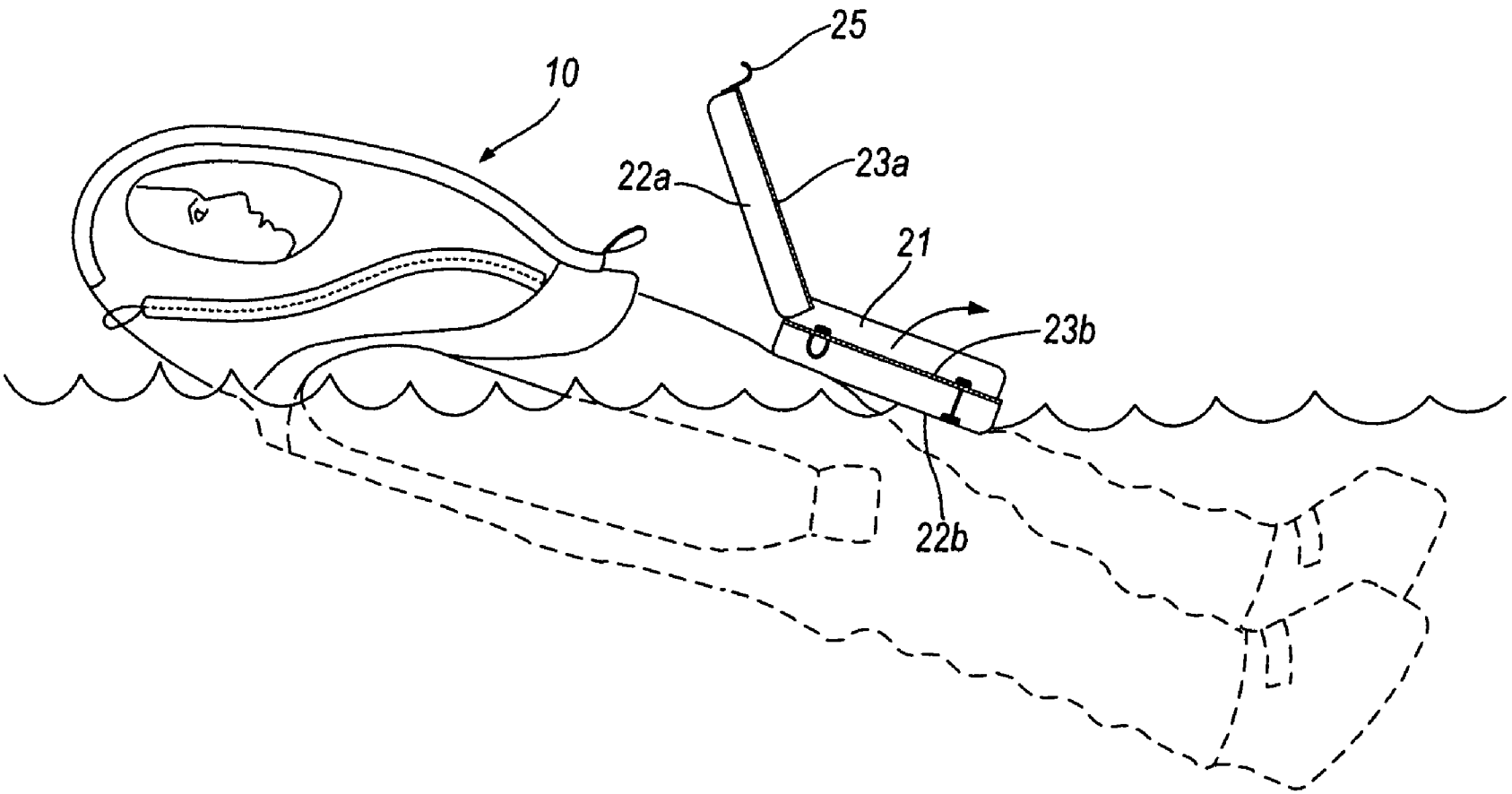
Figure 6:
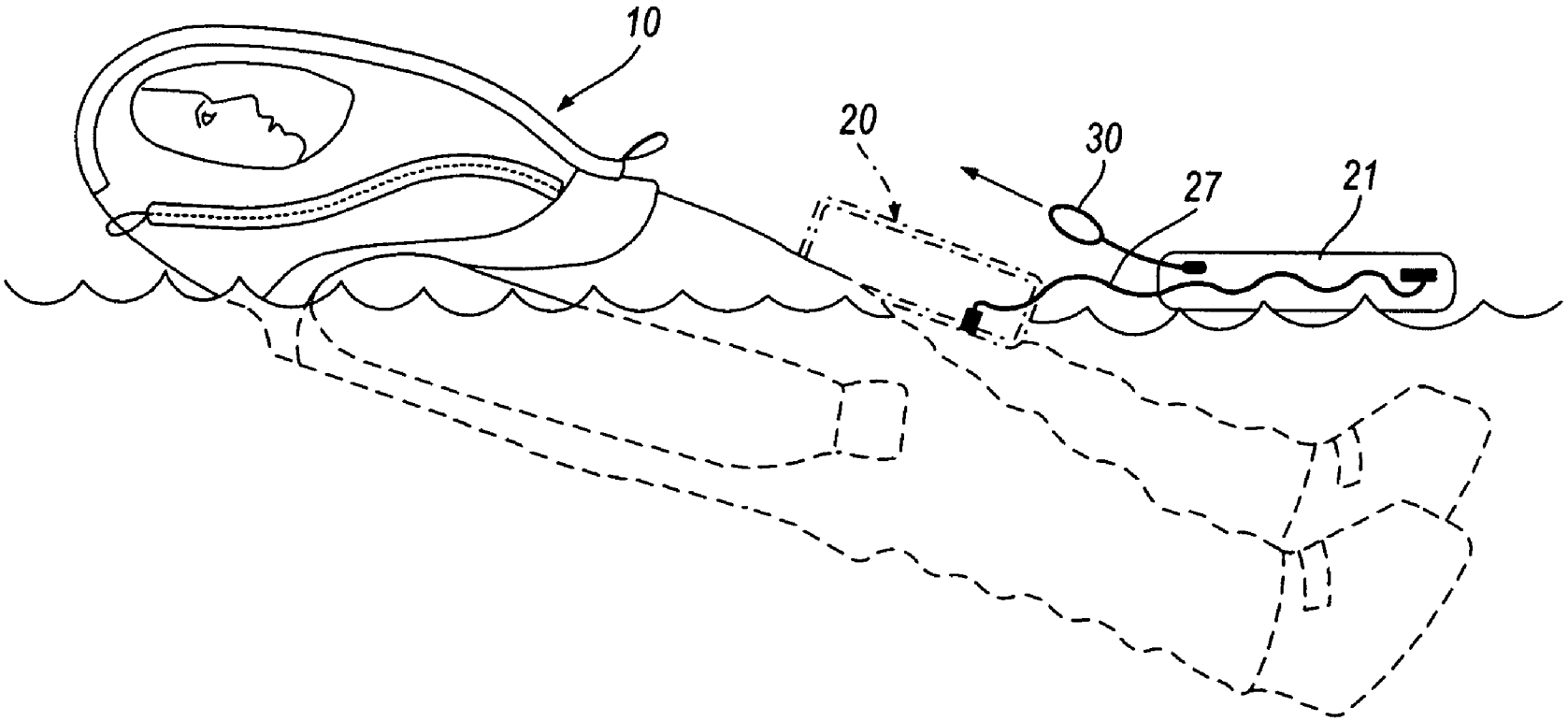
Figure 7:
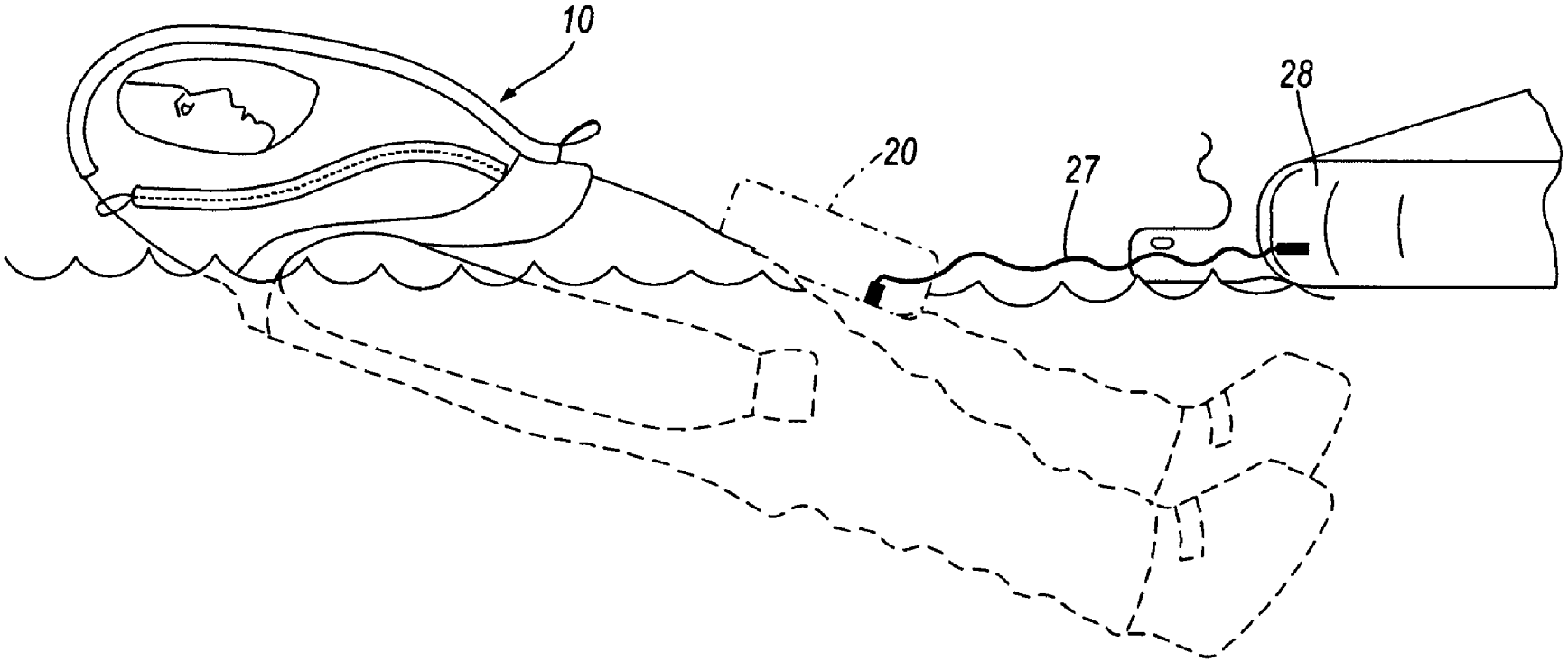
Figure 8:
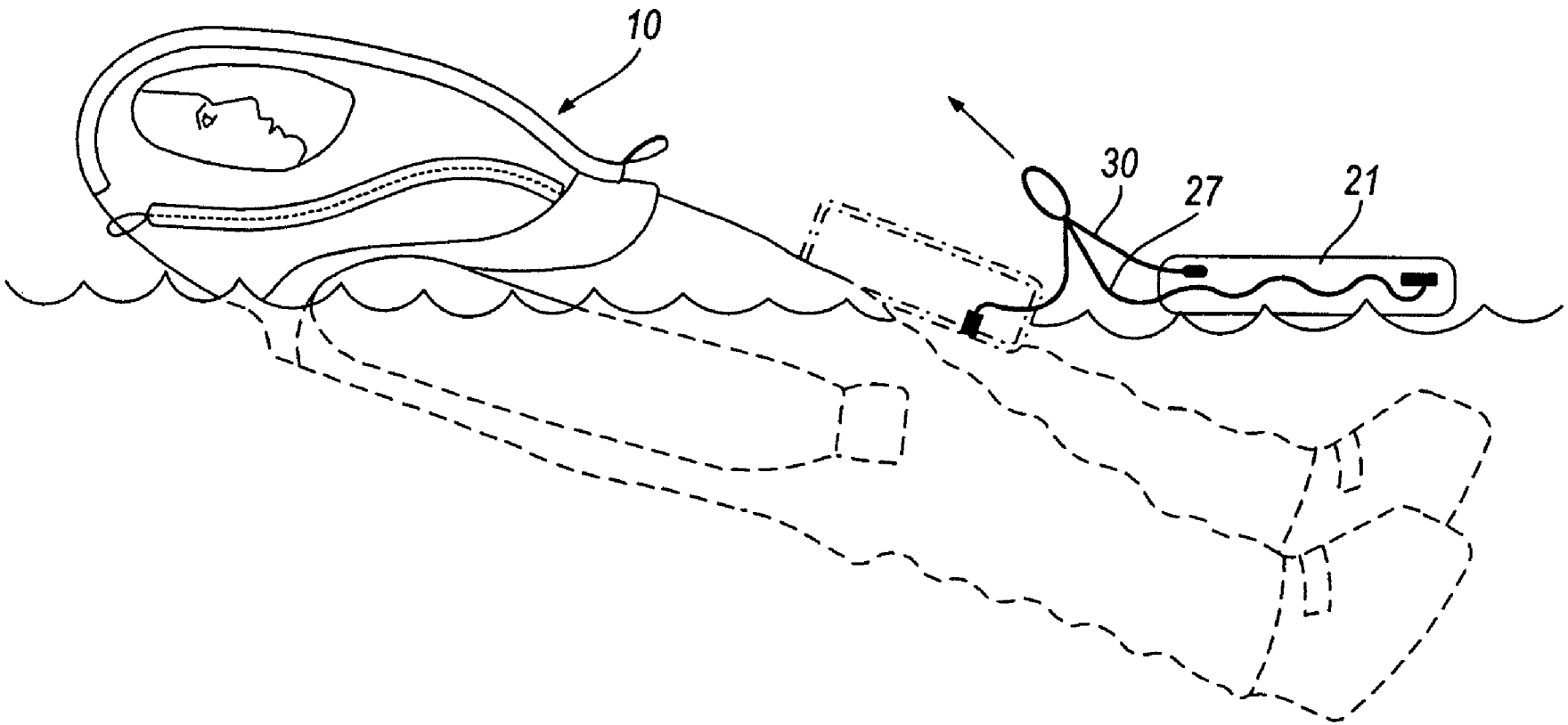

FIG. 1 is a front elevation of a submarine escape suit assembly including a submarine escape suit and a liferaft pack, FIG. 2 is a schematic side elevation, partly in section, of the liferaft pack of FIG. 1, FIG. 3 is a schematic end elevation, partly in section, of the liferaft pack of FIGS. 1 and 2, FIG. 4 is a view of a person wearing the submarine escape suit assembly of FIGS. 1, 2 and 3 on the surface of the sea and showing a first stage in the deployment of the liferaft, FIG. 5 is a similar view to FIG. 4 but showing a second stage in the deployment of a liferaft, FIG. 6 is a similar view to FIGS. 4 and 5 but showing a third stage in the deployment of the liferaft, FIG. 7 is a similar view to FIGS. 4 and 5 as showing the liferaft deployed, and, FIG. 8 is a similar view to FIG. 6 but showing an alternative method for deploying the liferaft.

Referring first to FIG. 1, the submarine escape suit assembly comprises a submarine escape suit indicated generally at 10 and a liferaft pack indicated generally at 11.

The submarine escape suit 10 is made from a waterproof flexible material such as a rubberised fabric or a plastic coated fabric. The suit has a body portion 12, arm portions 13 and leg and boot portions 14. These parts are conventional and will not be described in further detail.

A hood 15 extends over the body portion and is provided with a zipped entry opening 16 and translucent panels 17. In addition, the hood 15 has two lateral connection lines 18 that allow a face panel 19 of the hood 15 to be pulled away from the remainder of the hood 15. This is described in more detail in our co-pending UK patent application no 0618632.4

The liferaft pack 11 is seen in more detail in FIGS. 2 and 3. The liferaft pack comprises an outer casing 20 and an inner casing 21. The outer casing 20 is formed by first and second casing parts 22*a*, 22*b*. Each of the first and second casing parts 22*a*, 22*b* has a generally rectangular surface surrounded by four upstanding walls. The first and second casing parts 22*a*, 22*b* are in register and the edges of two respective adjacent walls are permanently connected to form a hinge 24 (see FIG. 2) between the first and second casing parts 22*a*, 22*b*. The edges remaining walls are interconnected by two rows of zipper teeth 23*a*, 23*b*. These teeth 23*a*, 23*b* extend continuously around the join between the first and second casing parts 22*a*, 22*b* except along a short stretch (see FIG. 3) of two of the sides of the first and second casing parts 22*a*, 22*b* opposite the hinge 24. At that point, the first casing part 22*a* is provided a pull flap 25.

The outer casing 22 is connected to the suit via reasonable connections 26 such as buckles or VELCRO™. The outer casing can be removed from the suit 10 for maintenance by releasing the connectors 26.

The inner casing 21 is connected to the suit by an elongate cord 27 that is arranged in a serpentine fashion within the outer casing 20 and passes through the outer casing 20 to connect to the suit 10 at one of the connections 26. The function of this will be described below. The outer casing 20 may be made from a lightweight fabric material.

The inner casing 21 is a hermetically sealed pack formed, for example, by a barrier foil. The inner casing 21 may be vacuum packed. The inner casing 21 contains a deflated liferaft 28 and an inflation system 29. The cord 27 extends through the inner casing 21 to connect to the liferaft 28. The inflation system 29 includes an actuating cord 30 that extends out of the inner casing 21 and is located in the outer casing 20.

The inner casing 21 carries a relative humidity indicator 31 that is aligned with a translucent window 32 in the outer casing 20 so that the indicator 31 can be read through the outer casing 20. The window 32 may be replaced by a hole. The inner casing 21 also contains a desiccant pack 33. This maintains relative humidity within the inner casing 21 to below 40% to prevent deterioration/corrosion of the liferaft 28.

In use, the submarine escape suit assembly is for escaping from a submarine. The wearer enters the suit 10 by opening the entry opening 16 and climbing into the suit 10 inserting arms into the arm portion 13, legs and feet into leg and boot portions 14 and body into the body portion 12. This configuration is shown in FIG. 1 where it will be seen that the liferaft pack 11 is located approximately at the waist of the wearer to the left hand side of the wearer.

The wearer then enters an escape chamber of the submarine where the wearer connects the suit to an air supply system of the submarine via a connector (not shown). The chamber then fills with water and a hatch opens to allow the wearer to ascend to the surface breathing the air within the suit 10 supplied by the system.

When the wearer reaches the surface, the wearer adopts the position shown in FIG. 4. In this first stage, the wearer is lying on his/her back with his/her head above water and the liferaft pack 11 exposed. If the wearer wishes to deploy the liferaft 28, the wearer grabs the pull flap 25 so separating the zipper teeth 23*a*, 23*b* and hinging the first casing part 22*a* about the hinge 24. This second stage is shown in FIG. 5.

The inner casing 21 is then released from the outer casing 20 and floats on the surface. This third stage is shown in FIG. 6. The inner casing 21 remains attached to the suit 10 by the cord 27 and the actuating cord 30 is exposed. The actuating cord 30 can then be pulled to operate the inflation system 29. Air is then supplied to the liferaft which bursts from the inner casing 21 for subsequent inflation and deployment of the liferaft. This final stage is shown in FIG. 7. In this position, the liferaft 28 can be boarded by the wearer.

This arrangement allows the wearer to choose when the liferaft 28 is inflated. In addition, inflation commences with the inner casing 21 separated from the suit 10 and this is an advantage.

It is not necessary to use a separate attachment cord 27 and actuating cord 30. As seen in FIG. 7, the connection cord 27 and the actuating cord 30 may be combined.

It will be appreciated that there are a number of other alterations that can be made to the arrangement described above with reference to the drawings. The form of the suit 10 is optional; any suitable submarine escape suit could be used. While it is preferred to have the liferaft pack 11 in the position shown in FIG. 1; it could situated at any other convenient location although the front of the suit is preferred because, if it is located elsewhere, the liferaft pack 11 may snag as the wearer leaves the escape chamber.

Although it is preferred that the inner casing 21 is hermetically sealed and vacuum packed, this is not essential. Although the connection between the first and second outer casing, parts 22*a*, 22*b* is shown as being by two sets of zipper teeth 23*a*, 23*b* that release when a force in excess of a predetermined minimum force is applied, other forms of releasable fastening could be used. For example, VELCRO™ could be used or a tear strip.

The hinge 24 is not essential; the first and second outer casing parts 22*a*, 22*b* could be completely separable.

The invention claimed is:

1. A submarine escape suit assembly comprising a submarine escape suit and a liferaft pack, the liferaft pack comprising an outer casing attached to the suit and an inner casing held within the outer casing and containing a deflated liferaft, the outer casing including a first casing part and a second casing part directly connected together by a releasable fastening that is configured to enable the first casing part to be at least partly separated from the second casing part, the connection provided by the releasable fastening being released when the first casing part is pulled apart from the second casing part, wherein the outer casing remains attached to the submarine escape suit during and after separation of the first and second casing parts, and separation of the first and second casing parts allows the inner casing to float free from the outer casing and to expose an actuation device that is operable to cause inflation of the liferaft.

2. A submarine escape suit assembly according to claim 1 wherein the first and second outer casing parts are partially permanently interconnected to form a hinge therebetween, the releasable fastening interconnecting all or substantially all of the remainders of the first and second outer casing parts.

3. A submarine escape suit assembly according to claim 1 wherein the releasable fastening comprises two sets of engaging zipper teeth that can be pulled apart by exertion of a force on the first casing part.

4. A submarine escape suit assembly according to claim 1 wherein the first outer casing part is formed with a handle for pulling said first outer casing part away from said second outer casing part to open the outer casing.

5. A submarine escape suit assembly according to claim 1 wherein the outer casing is connected to the submarine escape suit by releasable straps.

6. A submarine escape suit assembly according to claim 1 wherein the liferaft is connected to the submarine escape suit by a cord, the cord passing through the inner casing and the outer casing.

7. A submarine escape suit assembly according to claim 1 wherein the actuation device comprises a cord connected to an inflation system of the liferaft.

8. A submarine escape suit assembly according to 7 wherein the liferaft is connected to the submarine escape suit by a cord, the cord passing through the inner casing and the outer casing, and wherein the actuation cord is the cord connecting the liferaft to the submarine escape suit.

9. A submarine escape suit assembly according to claim 1 wherein the inner casing is hermetically sealed.

10. A submarine escape suit assembly according to claim 1 wherein the liferaft is vacuum packed in the inner casing.

11. A submarine escape suit assembly according to claim 1 wherein the inner casing contains a packed deflated liferaft and an inflation system connected to said actuation device.

12. A submarine escape suit assembly according to claim 1 wherein the inner casing contains a relative humidity indicator for indicating the relative humidity within the inner casing, the outer casing having a window through which the relative humidity indicator can be viewed.

13. A method of deploying the liferaft recited in claim 1, wherein the liferaft is ready for use upon performance of the following acts: opening the outer casing; removing the inner casing from the outer casing, and then inflating the liferaft using the actuation device.

* * * * *

UNITED STATES PATENT AND TRADEMARK OFFICE

CERTIFICATE OF CORRECTION

PATENT NO. : 8,092,267 B2
APPLICATION NO. : 12/442373
DATED : January 10, 2012
INVENTOR(S) : Taylor et al.

It is certified that error appears in the above-identified patent and that said Letters Patent is hereby corrected as shown below:

On the title page: Item #75
Line 2, change "Ruthin" to --Llanbedr--

Column 1
Line 60, change "no 0618632.4" to --No. 0618632.4.--

Column 3
Line 9, change "could situated" to --could be situated--

Column 4
Line 20, change "to 7" to --to claim 7--

Signed and Sealed this
Twenty-ninth Day of May, 2012

David J. Kappos

David J. Kappos
*Director of the United States Patent and Trademark Office*